US011982141B2

(12) United States Patent
Yoder

(10) Patent No.: US 11,982,141 B2
(45) Date of Patent: May 14, 2024

(54) WELLSITE HOSE AND CONDUCTOR PAYOUT AND RETRACTION METHOD AND SYSTEM

(71) Applicant: Phillip B. Yoder, Lake Charles, LA (US)

(72) Inventor: Phillip B. Yoder, Lake Charles, LA (US)

( * ) Notice: Subject to any disclaimer, the term of this patent is extended or adjusted under 35 U.S.C. 154(b) by 0 days.

(21) Appl. No.: 18/138,498

(22) Filed: Apr. 24, 2023

(65) Prior Publication Data

US 2023/0349246 A1 Nov. 2, 2023

Related U.S. Application Data

(60) Provisional application No. 63/337,304, filed on May 2, 2022.

(51) Int. Cl.
*E21B 19/22* (2006.01)

(52) U.S. Cl.
CPC ..... *E21B 19/22* (2013.01)

(58) Field of Classification Search
CPC ..... E21B 19/22
See application file for complete search history.

(56) References Cited

U.S. PATENT DOCUMENTS

| | | | | | |
|---|---|---|---|---|---|
| 3,766,996 | A * | 10/1973 | Moody | E21B 19/084 | 173/147 |
| 3,958,594 | A * | 5/1976 | Masters | B65H 75/38 | 137/355.12 |
| 4,476,945 | A * | 10/1984 | Hearn | E21B 19/22 | 175/203 |
| 4,945,938 | A * | 8/1990 | Ponsford | B60P 3/035 | 137/15.01 |
| 5,211,203 | A * | 5/1993 | Vollweiler | B65H 75/4402 | 137/355.21 |
| 5,598,866 | A * | 2/1997 | Nelson | B65H 75/425 | 137/355.27 |
| 10,246,293 | B2 * | 4/2019 | Rekieta | B65H 75/4481 | |
| 2010/0314132 | A1 * | 12/2010 | Coles | E21B 19/22 | 166/77.2 |
| 2013/0020271 | A1 * | 1/2013 | Nero | B66D 1/30 | 211/85.5 |

* cited by examiner

*Primary Examiner* — Matthew R Buck

(57) ABSTRACT

A reel system allows for storage, paying out, and retrieval of conductors, such as high pressure hydraulic hose, electrical conductors, or any other length of reeled conductor. For well operations, hydraulic control hose may be filled or dry for storage. Pigtail ends of the hose pass through an aperture of a core of a reel into an umbilical space. The hose may be payed out as needed at the job or well site, and the pigtail ends then removed from the umbilical space for connection to a source of pressurized fluid. The reel may be immobilized from rotation during this stage. Once the onsite operations are complete, a drive system may be powered to cause rotation of the reel to retrieve and restore the hose. Multiple hoses may be stored on the reel, and multiple reels may be mounted and independently driven on a common support of the system.

20 Claims, 7 Drawing Sheets

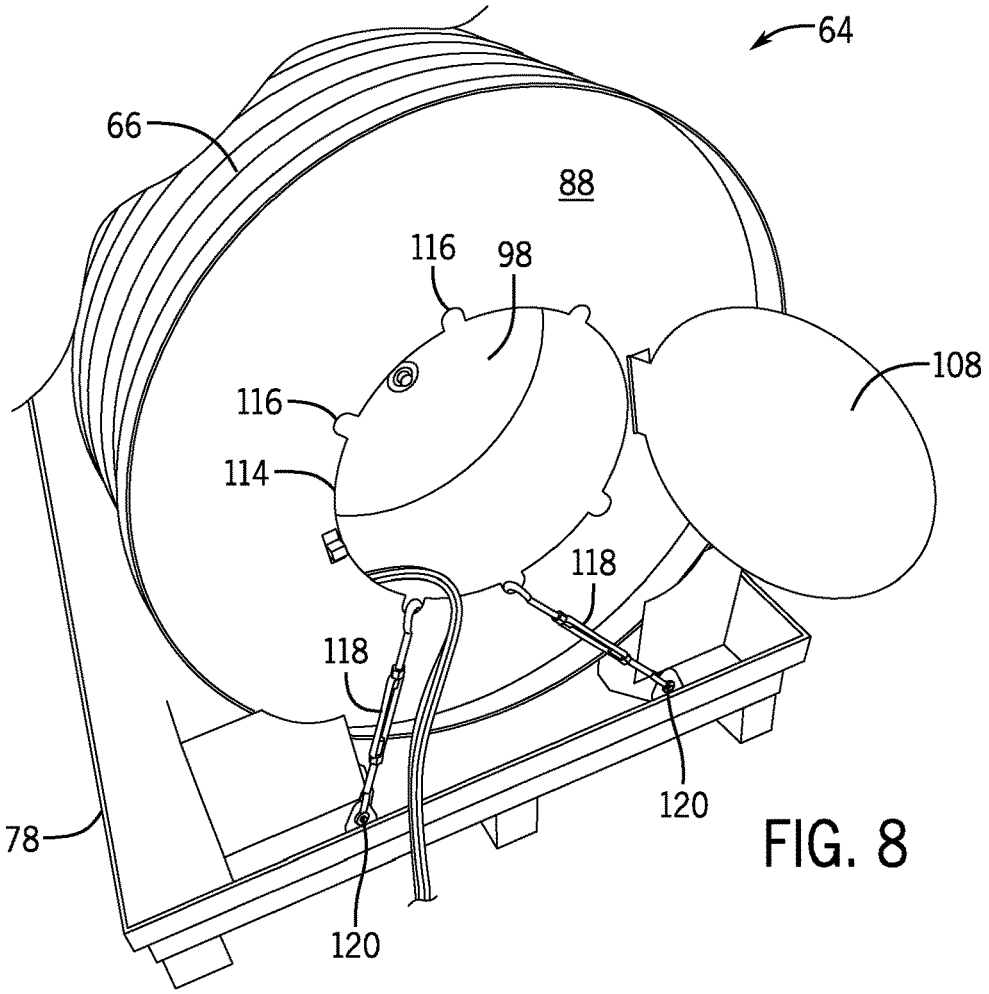
FIG. 8
FIG. 9
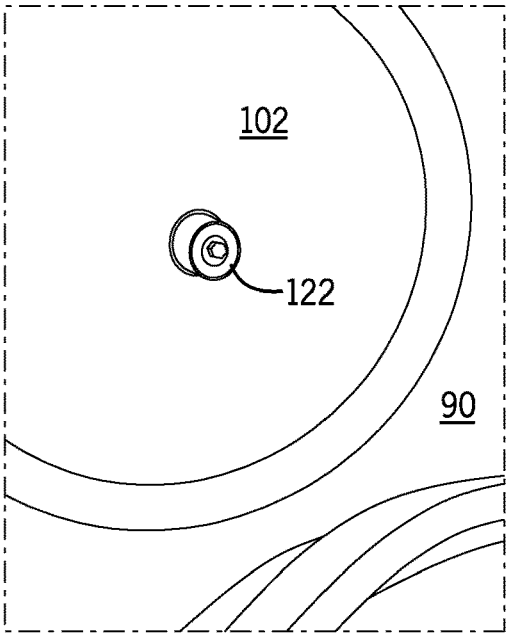

WELLSITE HOSE AND CONDUCTOR PAYOUT AND RETRACTION METHOD AND SYSTEM

CROSS-REFERENCE TO RELATED APPLICATION

This application claims priority to and the benefit of U.S. Provisional Patent Application Ser. No. 63/337,304, entitled "Wellsite Hose and Conductor Payout and Retraction Method and System," filed May 2, 2022, that is incorporated herein by reference in the entirety.

BACKGROUND

The present disclosure relates generally to the management of hoses and other conductors in well applications.

Well locations for oil and gas exploration, drilling, completion, production, and servicing present many unique challenges not faced or addressed in other technical fields. For example, during certain stages in the life of wells, very considerable investments are required in terms of specialized equipment and highly-trained manpower to put into place and operate devices that are positioned deep in a wellbore under conditions that are both demanding technologically, and dangerous, depending upon well conditions. This is true, for example in hydraulic fracturing ("fracking") operations, where many different specialized teams of equipment operators need to be in place and cooperating to install, interconnect, and operate the required systems. And all of this must be done in an efficient manner to contain costs while respecting stringent regulations and time constraints.

A number of the systems that are used in well applications, particularly in fracking, are hydraulically driven, using high pressure oil hydraulic fluids that are pumped from a power supply to hydraulic motors, cylinders, and other actuators at and around the well location. (Note that this use of the term hydraulic is distinguished from the "hydraulic" fracking deep within the well, which is typically done with a slurry of water, sand, and other constituents.). In well fields where multiple wells are closely spaced, such hydraulic equipment may be positioned, repositioned, and interconnected to provide a whole range of operations, such as actuating wireline valves and other valves, actuating motors, actuating blowout preventors, to mention only a few. Moreover, the current state of the art requires that much of this equipment is spaced from the well itself around an area sometimes called "the red zone". Consequently, long hoses and other conductors (e.g., electrical power and sensory cables) are run and connected to the well equipment before any operations can proceed. Following these operations, then, all of these must be recaptured, packaged, stored, and moved.

Complicating these operations are the facts that the hydraulic hoses used are heavy and often dirty and slippery due to the unique demands of the hydraulic equipment, pressures, and fluids involved. Techniques for deploying these conductors, connecting them in place, testing them, disconnecting them, and retrieving them has evolved very little over time. Current approaches involve manually transporting multiple hoses of sometimes hundreds of feet and weighing hundreds of pounds to well locations, and stretching them out between power sources and actuators, making the needed connections, and then testing and finally employing the hydraulics in cooperation with other well-servicing operations by the on-location specialized teams. After use, the hoses are then drained to the extent possible, re-coiled (and sometimes taped or otherwise bound), and reloaded on trucks for transport away from the location. It should be apparent, and as is well-known to those skilled in the art, these jobs are messy, time consuming, and inefficient.

Some limited efforts have been made to address this problem by using hose reels. A key challenge, though, is that both ends of the hoses must be available for connections—that is, a distal end that is stretched out to the actuator location, and a base end that for connection to the power source, typically a valve bank, manifold, or hydraulic power unit. Conventional hose reels do not allow easy access to the base end without completely removing the hose from the reel, thereby greatly limiting the use by unnecessarily, in some cases, removing great lengths of hose that is not actually used or needed in particular applications. Some reels, typically known as live reels (as opposed, for example, from storage reels), may address this problem by the use of high pressure swivel joints at an inlet or base end. Such reels are made, for example, by Hannay Reels Inc. of Westerlo, New York. However, these are expensive, and are in most cases limited to one or two conduits. Higher flow rates (that is, sizes) and greater numbers of hoses make these either prohibitively expensive, or unavailable at all.

There is a keen need in this field for straightforward solutions for storing, transporting, deploying, using, and recapturing multiple high pressure hoses and other conductors. In particular, any successful solution must be extremely robust and flexible for addressing the demanding environments and real-world constraints of well applications.

SUMMARY

A summary of certain embodiments disclosed herein is set forth below.

BRIEF DESCRIPTION OF THE DRAWINGS

Various aspects of this disclosure may be better understood upon reading the following detailed description and upon reference to the drawings described below in which like numerals refer to like parts.

FIG. 8 is a side perspective of the reel showing how access may be provided to the umbilical space;

FIG. 9 is a perspective detail view of a drive plate for controlling take-up of conductors;

DETAILED DESCRIPTION OF SPECIFIC EMBODIMENTS

Figure 1:
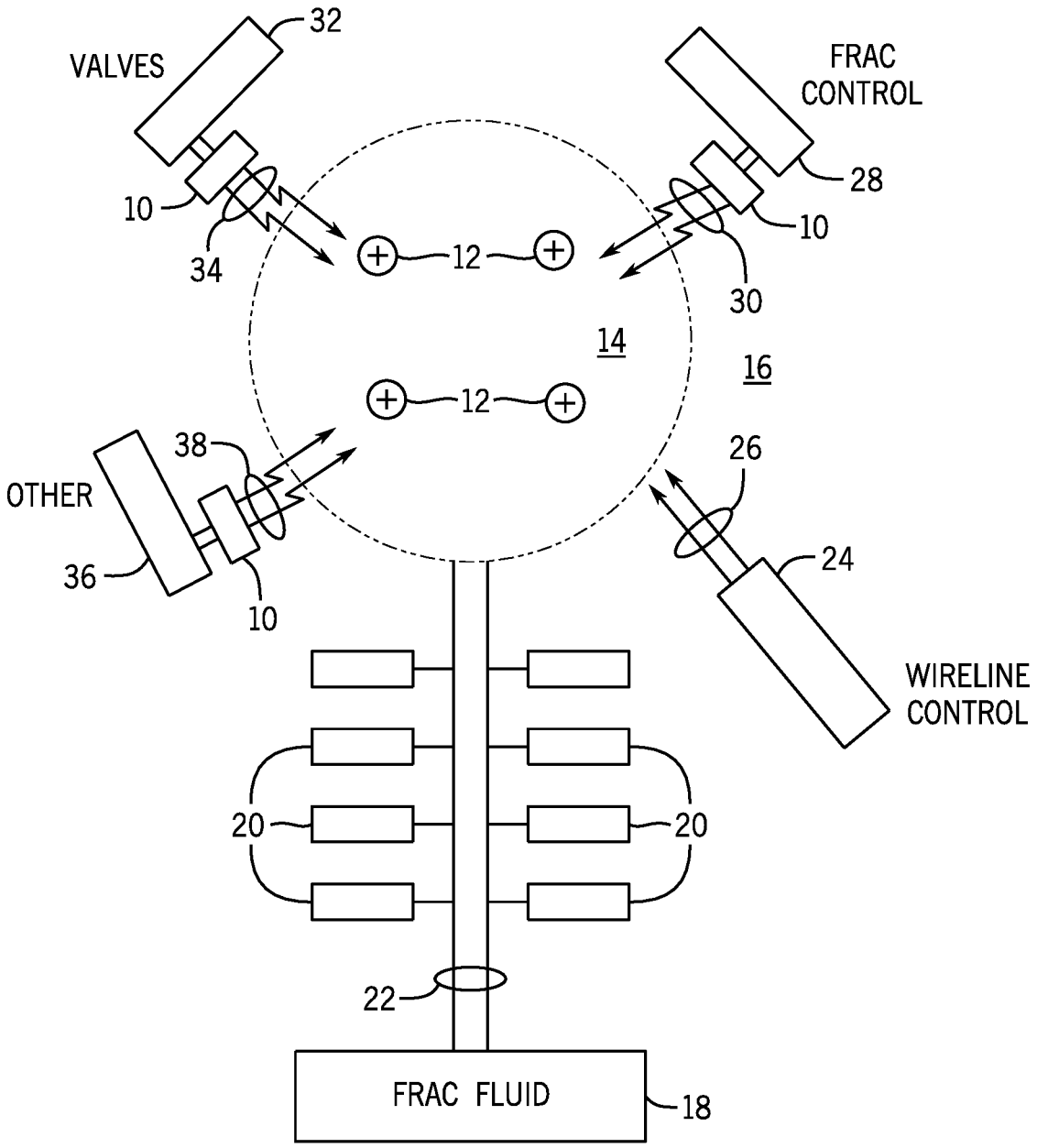
FIG. 1 is a diagrammatical representation of an exemplary well application in which multiple services are provided to wells, these including hydraulic power applied to components using reels and management techniques disclosed.

FIG. 1 illustrates an exemplary well application in which the invention may be employed. As illustrated, a wide range of systems, equipment, and teams may be present and contribute to the particular well operations envisioned. Much of this equipment may be of types presently used for exploration, completion, workover, fracking, and so forth. By way of example, FIG. 1 shows multiple reel systems 10 according to the present disclosure applied in a fracking operation in which multiple wells 12 are to be worked. In the application shown, the wells are located in a "red zone" 14 surrounded by a peripheral zone 16 in which required services and personnel are positioned during the actual operation.

A wide range of equipment may be needed or useful during processes at oil and gas wells. It should be borne in mind that the present discussion is intended only to provide a cursory outline of such equipment, and those skilled in the art will recognize that the equipment and systems may vary widely depending upon the wells being serviced, the operations being performed, and so forth. Indeed, the reels and techniques described here, while adapted for oil and gas well applications are equally well suited or may be readily adapted to a host of other uses, such as firefighting, spray and pressure washing, rescue operations, aviation applications, agricultural operations, audio/video cable uses, construction uses, fuel delivery, industrial applications, mining applications, sewer and waste applications, public utility applications, welding applications, and so forth. Further, it should be understood that while high pressure hydraulic well equipment control hoses are described here as an important resource that may be stored on, payed out from, and retrieved via the reel systems described, more generally "conductors" or any type may be used in conjunction with the reels, particularly hoses of other types, control or data cables, power cables, and so forth.

Returning to FIG. 1, then, the illustrated equipment and services include fracking pressure services including a fracking fluid source 18 and pumping equipment 20 interconnected by high pressure conduits 22. As those skilled in such operations will recognize, these systems may provide for storing and pumping water and other fluids, sands and similar solids, chemicals, and so forth. Blenders, separators, conveyors, monitoring equipment, and so forth may also be provided. Wireline equipment is provided and controlled as well, as indicated generally by reference numeral 24. The wireline equipment extends into the red zone as indicated by reference 26. Such equipment allows for raising and lowering various equipment into the well, such as perforating devices, well logging systems, and so forth. Further, operations control services 28 are provided to monitor and coordinate the operations. These may be connected to well equipment via conductors 30. Various valving and ancillary equipment may be provided as indicated by reference 32. Such valving is generally connected to the pressure sources (and control/monitoring stations, not separately shown) by conductors 34, including high pressure hydraulic control hoses. The figure further illustrates "other" equipment and systems 36 that may be provided and connected to equipment at the site via conductors 38. As shown in the figure, some (or all) of these services may be connected to equipment at the site via conductors that are stored on and drawn from reels 10 of the type described.

In a typical operation, the various equipment and services are brought in and positioned around the well site, and all communications, flow lines, control lines, instrumentation lines, and the like are run and interconnected with the well equipment (and one another where required) in a carefully coordinated process that may take days. Conditions at the site may make such operations challenging, particularly where manual routing and interconnection of the hoses, conductors, wiring, and data cables is done largely manually, as it is in most cases. The present approach to storing and deploying hoses and other conductors is intended to greatly facilitate and speed that process.

Figure 2:
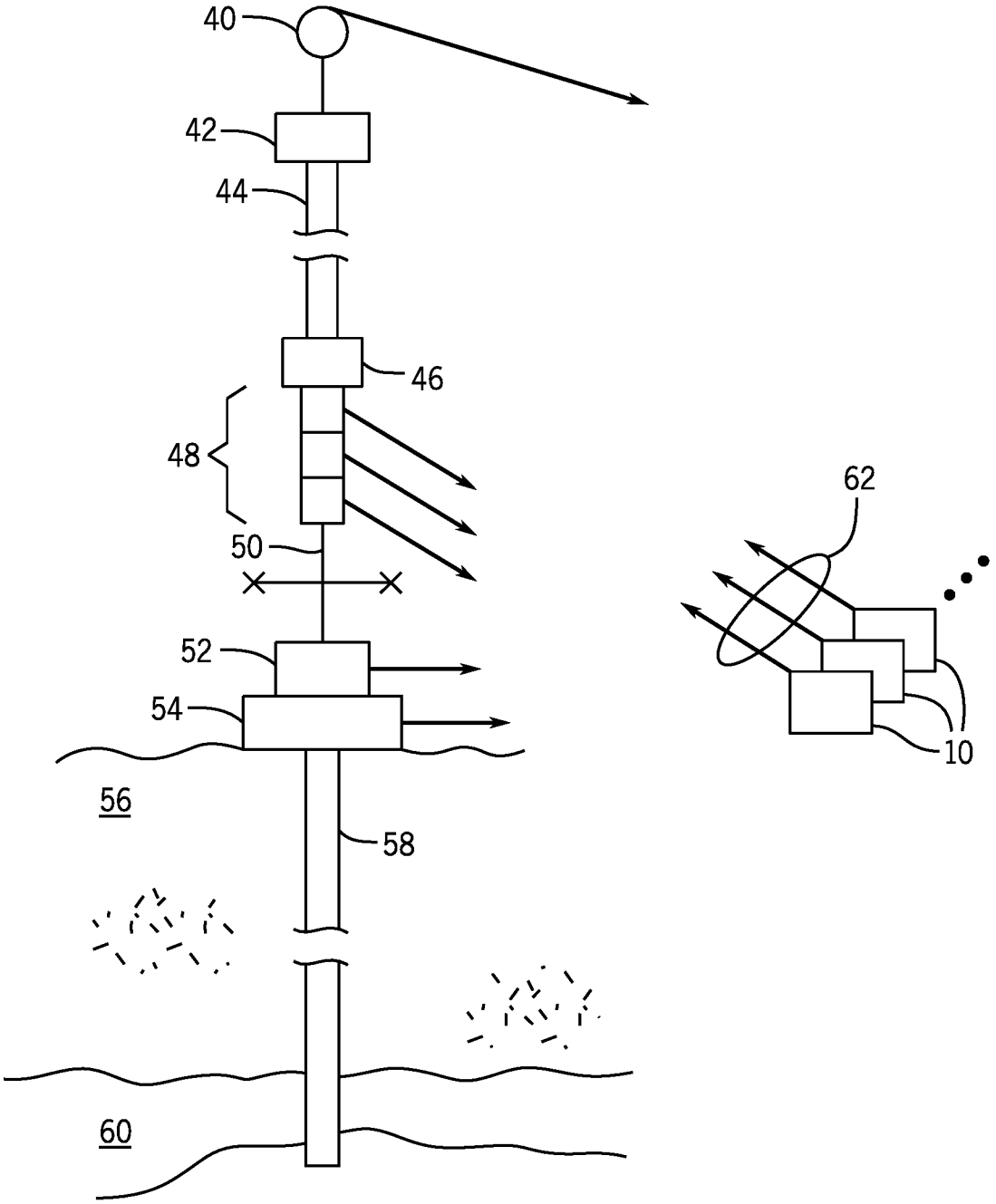
FIG. 2 is a more detailed view of certain of the components that may be actuated by hydraulic power applied via hoses and other conductors in accordance with the disclosure.

FIG. 2 illustrates a simplified example of equipment assembled above a well in a fracking (or other) well application that may make use of the present reel systems. In the example, a sheeve, gooseneck, and associated support structure 40 above the well allows for raising and lowering equipment, such as via a wire line or crane. A grease head or packoff 42 allows for sealed passage of the wireline in and out of the well. A lubricator 44 houses a number of components, such as a disconnector, a centralizer, a ball seat, a perforator, a packer, a locator, a decompression sub, and so forth, which will not be described here as they are, in themselves, beyond the scope of the present discussion. A tool trap 46 is positioned below the lubricator, and below the tool trap, wireline valves 48 are connected. A "Christmas tree" 50 may be positioned below the wireline valves. Among the other equipment in the installation may be a king valve 52, a master valve 54, as well as blow out preventors, and so forth.

Of course, for any oil or gas well application the foregoing equipment is positioned on or near the surface of the ground 56 traversed by a well 58. The well penetrates one or more zones of interest 60 from which minerals will hopefully be accessed and extracted. Operations might, then include detecting parameters of such zones, perforating rock in the zones, fracturing the rock, and so forth. In practice, a number of wells may be drilled and serviced in a single site (as shown in FIG. 1). The use of the reel systems described may greatly facilitate routing conductors between such co-located wells.

Some of these components are connected to services via hoses, cabling, and so forth, particularly to provide pressurized hydraulic fluid flow to actuate them. This is the case, in the illustrated example, of the wireline valves 48 and the valves 52 and 54. As shown in the figure, then, these may be connected to their remote equipment and services via reels 10.

Figure 3:
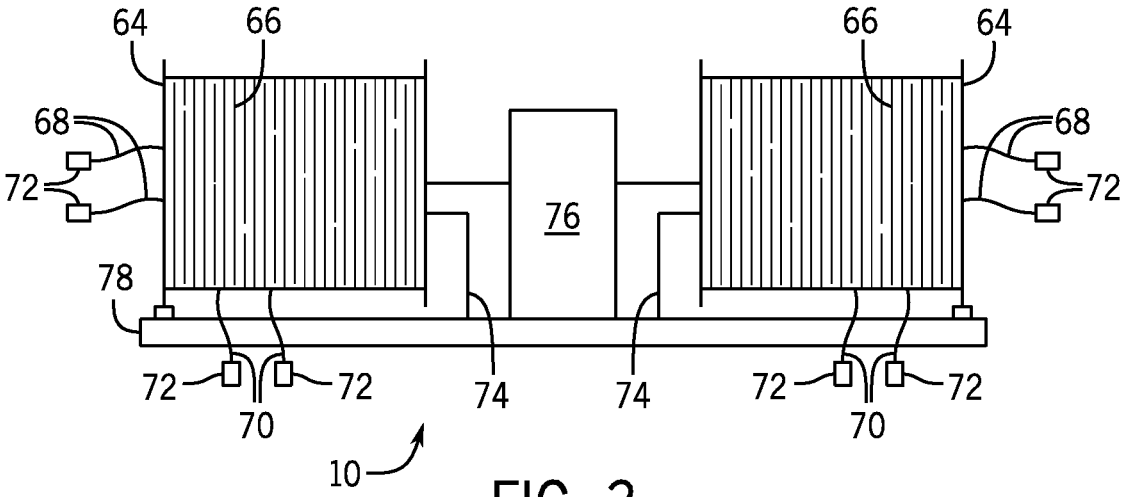
FIG. 3 is a diagrammatical view of an exemplary reel that may be used for multiple high-pressure hydraulic hoses in accordance with the disclosure.

FIG. 3 is a diagrammatical view of an exemplary reel system 10 that includes a pair of reels 64, though in some embodiments a single reel or more than two may be provided in a system. The reels store conductors needed at the site, which in this case are high pressure hydraulic hoses. While these may be transported or stored empty, in some applications, and during operations, they will be filled with hydraulic fluid (e.g., oil) and purged of any air or gases. This, of course, makes manual manipulation of the hoses difficult, particularly in view of the additional weight, the lubricity of the fluids, and so forth. But the techniques described greatly facilitate paying out of the hoses, their connection to other equipment, and their retrieval, particularly as compared to all existing techniques.

As illustrated, the reels 64 store hose 66. In current embodiments, it is contemplated that one or more (e.g., two, three, four, etc.) hoses may be stored parallel on each reel, and payed out together at the worksite. Moreover, an advantage of the reels compared to present techniques at well sites is that only the amount of hose needed is drawn from the reels, the rest remaining wound and stored. Each hose has a pigtail or umbilical end 68 extending from an inner space (discussed below), and a distal or application end 72 that is free to be pulled to the application or actuator. In current embodiments, hydraulic quick disconnect fittings are mounted on the ends of the hoses to allow rapid and easy connections, and to retain the hydraulic fluid within them. In the illustrated embodiments, the reels are supported by a mechanical support bracket 74 on an inboard side, though many different physical supports may be envisioned. In the embodiment shown with two reels, a hydraulic drive 76 is positioned between them and connected to hydraulic motors (discussed below) to allow powered retrieval of the hoses. The entire assembly is mechanically mounted on a support base 78, such as a skid. In some embodiments, the skid may be designed for lifting with a fork lift or crane, or it may be mounted permanently or removably on a truck for ease of transport.

Figure 4:
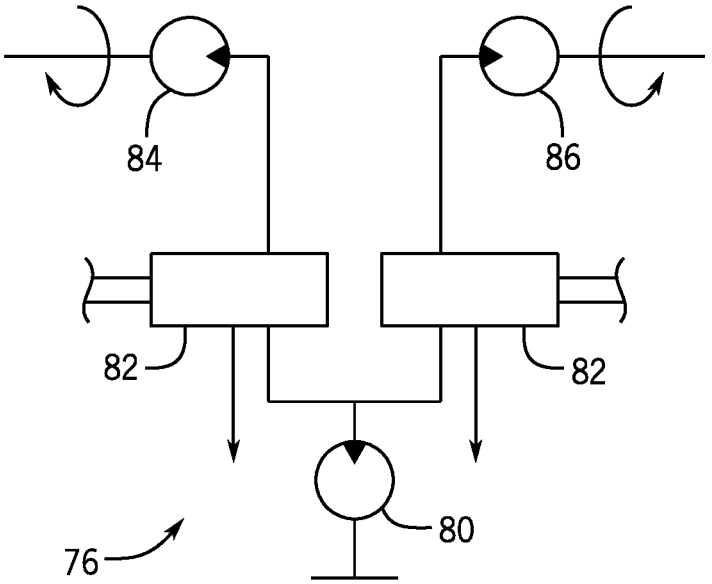
FIG. 4 is a diagrammatical representation of components of an exemplary hydraulic drive for the reel.

FIG. 4 shows some principal components of a hydraulic drive 76. However, it should be borne in mind that any desired drive system may be used for retrieval of the hoses, such as engine drives (e.g., with clutches, brakes, etc.), hydraulic accumulators, pneumatic drives, and so forth. In the illustrated drive, a hydraulic pump 80 draws fluid from an onboard reservoir and provides a flow of pressurized fluid to valving 82, such as manually or electromagnetically operated directional control valves. The pump may be powered by a small internal combustion engine (not shown), a pressurized air source, or any other means. The valving allows for independent control of hydraulic motors 84 and 86 on each powered reel. For paying out of the conductors, the valving may be positioned in freewheeling positions, or a clutch arrangement may be used to allow free rotation of the reels. When not required for retrieval of the hoses, the power unit of the drive may be shut down, of course.

Figure 5:
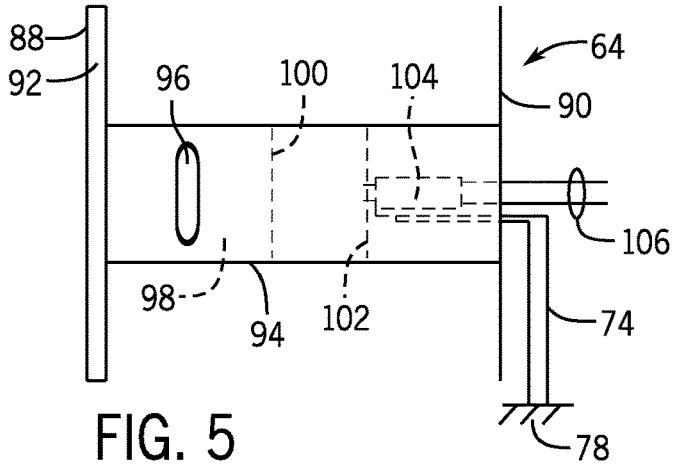
FIG. 5 is a diagrammatical view showing a layout of elements of the exemplary reel.

FIG. 5 illustrates features of a presently contemplated reel assembly. In this embodiment, the reel has a pair of side discs 88 and 90. To facilitate support and rotation of the reel, a rim 92 may extend from one or both of the discs (for rolling contact with casters on the support structure as discussed below). The core or hub 94 of the reel is a hollow metal structure that serves to form a unitary structure with the side discs, and to store the hose (or other conductors), their motion being limited by the side discs. An aperture 96, in this case a generally oval hole, is provided in the core to communicate with an inner space 98, here termed an umbilical space because when the hoses or conductors are not connected to a source of power (e.g., pressurized fluid) they can be coiled and stored in this space for connection once they are unwound for use at a jobsite. As shown in broken lines in the figure, an inner plate 100 is fixed (e.g., welded) within the core to help define this space, and a second, drive plate 102 is similarly fixed (e.g., welded) towards the opposite side of the core. This drive plate is coupled to the output shaft of a hydraulic motor 104 (corresponding to one of the motors 84 or 86 of FIG. 4). Hydraulic tubing 106 is connected to this motor and allows for the supply and return of pressurized fluid from the drive to cause powered rotation of the reel.

In a current embodiment, the reel is supported at the drive side by the bearings of the hydraulic motor, which is solidly fixed (e.g., bolted) to the support 74. The opposite side of the reel may be rotationally supported on casters (see below) on the support 78). This arrangement greatly simplifies the structure, and alleviates the need for heavy bearings in the reel, or separate supports for them. Of course, where desired, the entire structure may be adapted for such bearings, or on the contrary, the reel side discs could both be supported by casters with the drive motor being less rigidly supported on its support.

Figure 6:
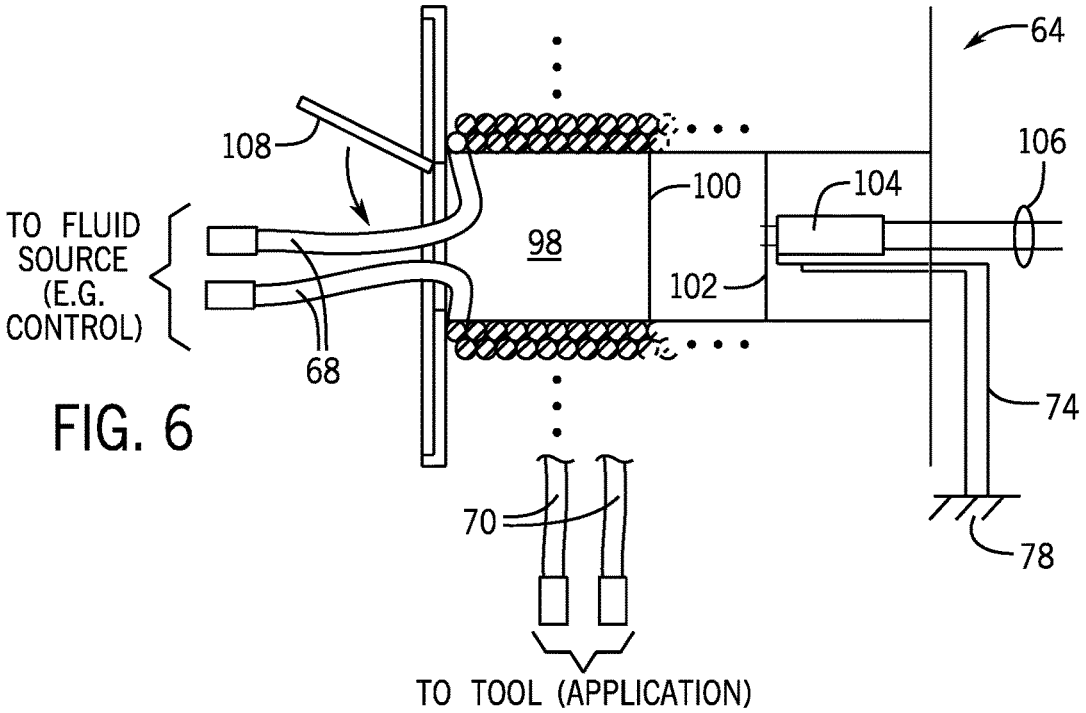
FIG. 6 is a diagrammatical sectional view of the reel in which conductors (e.g., hoses) are removable from an umbilical space of the reel.
Figure 7:
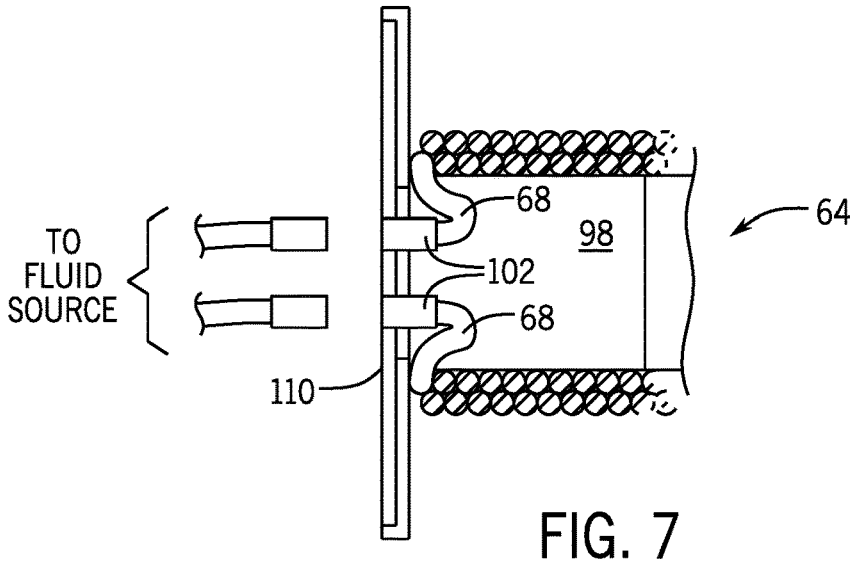
FIG. 7 is a similar view showing how the conductors may be positioned in the umbilical space but terminated in a side panel of the reel.

FIGS. 6 and 7 show diagrammatical sections through parts of the reel, and illustrates the components mentioned above, such as the support 74 for the motor 104, the output shaft of which again is coupled to the drive plate 102. As shown, the umbilical space 98 is formed by the core and the inner plate 100. The pigtail or umbilical ends of the hoses (or conductors) are routed into this space (via the opening 96 shown in FIG. 5) and once the hoses (or conductors) are payed out sufficiently, these removed (uncoiled) from the space 98 and extended for attachment to a source of power (e.g., a pressure source for hydraulic control of actuators such as valves, motors, etc.; or an electrical source for electrically powered actuators; or instrumentation for any desired data collection). In the embodiment shown in FIG. 6, a hinged panel or door 108 is provided to cover a side opening in the side disc of the umbilical space. This panel may be normally closed for transport and storage of the reel, and then opened once the hoses are unwound at the jobsite for coupling to the pressure source. Alternatively, in the embodiment of FIG. 7, a removable plate 110 is provided and the pigtail or umbilical ends of the hoses are terminated (e.g., the fittings are mounted) to this plate 110. The plate would advantageously be removable for installation, access to and servicing of the hoses when desired.

FIGS. 8-11 are partial perspective views of present embodiments of the reel assembly discussed above. As shown in FIG. 8, the reel 64 is mounted on the support 78 and hose 66 is wound on it. An opening 114 in the side disc 88 allows access to the umbilical space 98 where the pigtail or umbilical ends of the hoses are stored and from which they can be drawn for connection. In this embodiment, notches 116 are formed around the periphery of the opening to allow for immobilizing the reel (that is, preventing its rotation) during transport and following deployment of the hoses. In this embodiment, links 118 mounted to brackets 120 may be removably latched into the notches to physically restrict rotation of the reel. Other immobilizing arrangements may, of course be used, such as brakes, manual or powered stops, and so forth.

Figure 10:
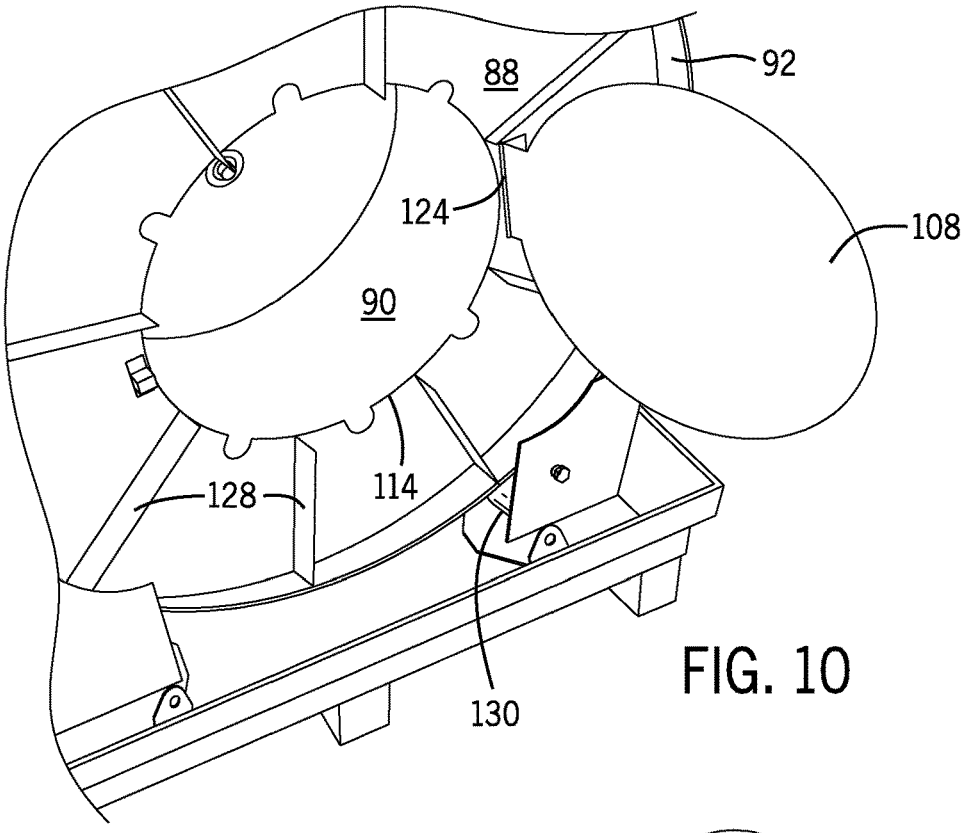
FIG. 10 is a perspective detail of an embodiment of an access panel to the umbilical space.
Figure 11:
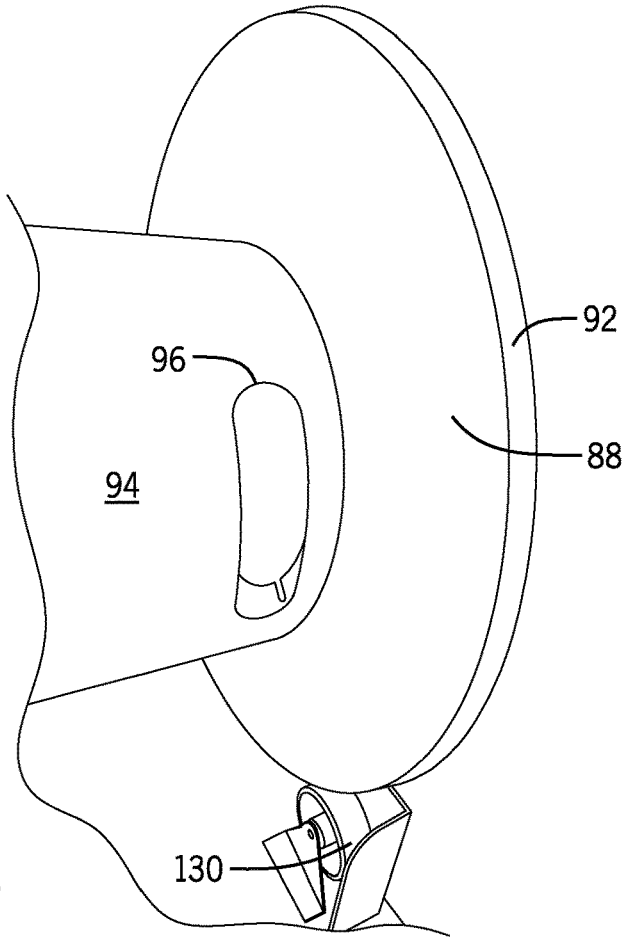
FIG. 11 is a detail view of an aperture provided in the reel core for passage of conductors.

FIG. 9 shows the opening in which the drive plate 102 is fixed. On this open end of side disc 90, the coupling 122 for the motor shaft may be seen. In this embodiment, the coupling is pre-fitted and fixed to the drive plate so that the motor only needs to be mounted, coupled to the coupling, and plumbed to the drive unit. FIG. 10 shows a similar embodiment from the side of the umbilical space 98. Here the panel or door 108 is shown swung open on a hinge 124. A latch 126 can be seen for securing this panel once closed. This embodiment is physically larger and therefore more robustly reinforced than the previous embodiments, such as by ribs or spokes 128 are fixed to the side disc 88. Also visible beneath the rim 92 of the side disc is a caster 130 on which the rim (and reel) journals for rotation. In some embodiments, a similar caster is provided on an opposite side of the reel (e.g., casters in the front and back of the reel) and these the spacing between these may be fixed by their mounting structures, or may be adjustable by one or more adjustable links (not shown). FIG. 11 illustrates a "front"

caster 130 that can cooperate with a "back" caster in a position shown in FIG. 10 in this way.

Figure 12:
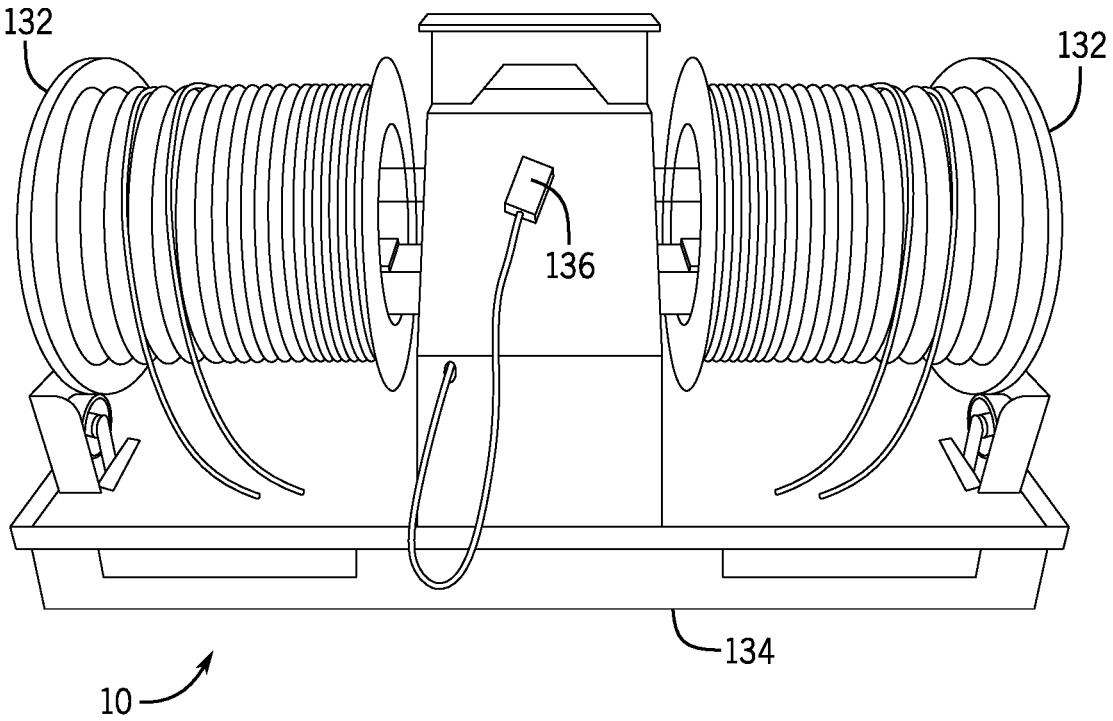
FIG. 12 shows an assembled reel unit having two reels driven by an onboard hydraulic drive unit.

FIG. 12 shows a finished assembly of two reels with a central drive system. As discussed above, in this type of arrangement, two reel assemblies 132 are mounted rotationally on the support, here designated by reference 134, which is designed for lifting by a fork lift. The drive system is shown as controlled by a connected hand-held control pod 136 (e.g., with push buttons for starting and stopping rotation of the reels.

In a practical application, the method for using the reels would follow operations such as this. The reel system would be transported to a jobsite, and positioned where desired (e.g., around a red zone of a wellsite). One or multiple parallel hydraulic control hoses wound into the storage space of the core of the spool assembly between the spaced side or lateral discs are payed out. These hoses may be prefilled with hydraulic fluid, or may be transported dry and filled at the jobsite. At this point, the pigtails or umbilical ends of the hoses are not connected to the source of power to allow them to freely rotate with the reel. It should be noted that this alleviates the need for complex and expensive live rotational or swivel fittings as on some existing reels. As noted above, only the required lengths of hose need to be payed out, and the remainder can continue to be stored on the reel. Once the hoses are deployed, the reel is immobilized, such as via the structures discussed above. If the pigtail or umbilical ends are stored in the umbilical space, these are pulled out and the pigtails are unwound. The hoses may be connected to the onsite equipment, typically a source of pressurized fluid on the pigtail end, and to an actuator (e.g., valve, valve bank, motor, manifold, or any other application) at the distal end, such a via quick disconnects on the ends of each hose. During these operations, the drive system may be powered off, or may be on if needed for shifting of valves, checking its operation, and so forth. Following use at the jobsite, then, the ends of the hoses may be disconnected (e.g., via the quick disconnects), and the pigtail ends returned to the umbilical space. The immobilization structure on the reel may be freed so that the drive system may be powered on and controlled to cause rewinding of the hoses on the reel.

The invention claimed is:

1. A well control method comprising:

paying out multiple parallel hydraulic control hoses wound onto a spool assembly that comprises a core and first and second spaced lateral discs forming a storage space for simultaneous storage of the hydraulic control hoses, the core having a central drive plate, one of the lateral discs having an opening to an inner umbilical space, the core having an entry aperture in communication with the umbilical space for passage of terminal umbilical ends of the control hoses into the umbilical space, the hydraulic control hoses having quick disconnect couplings on the terminal umbilical ends and distal ends thereof, wherein the terminal umbilical ends of the control hoses are stored in the umbilical space and rotate with the spool assembly;

connecting the terminal umbilical end of each hydraulic control hose to source of pressurized hydraulic fluid;

connecting the distal end of each hydraulic control hose to an actuator input at a wellsite; and controlling the actuators with hydraulic power via the hydraulic control hoses.

2. The method of claim 1, comprising manually paying out the hydraulic control hoses and then securing the spool assembly against rotation.

3. The method of claim 1, wherein an access panel is movable to access the terminal umbilical ends of the control hoses freely stored in the umbilical space, and the terminal umbilical ends are extracted from the umbilical space prior to connection to the source of pressurized hydraulic fluid.

4. The method of claim 1, wherein the terminal umbilical ends of the control hoses are terminated to the respective quick disconnect couplings through an access panel.

5. The method of claim 1, comprising disconnecting the control hoses from the source of pressurized hydraulic fluid and from the actuator inputs, and spooling in all of the control hoses simultaneously via a hydraulic drive motor coupled to the drive plate of the spool assembly.

6. A multi-conductor hydraulic control hose reel system comprising:

a spool assembly having a core and first and second spaced lateral discs forming a storage space for simultaneous storage of multiple parallel hydraulic control hoses wound onto the core, the core having a central drive plate, one of the lateral discs having an opening to an inner umbilical space, the core having an entry aperture in communication with the umbilical space for passage of terminal umbilical ends of the control hoses into the umbilical space;

a hydraulic drive motor mechanically coupled to the drive plate to drive the spool assembly in rotation;

a support structure holding the spool assembly and the drive motor; and wherein the terminal umbilical ends comprise lengths of the hoses that are wound and stored in the umbilical space, and an access panel is movable to permit extraction of the terminal umbilical ends of the hoses from the umbilical space; and wherein when the multiple parallel hoses are wound onto the core and prior to coupling of the terminal umbilical ends to other equipment, the terminal umbilical ends rotate with spool assembly.

7. The system of claim 6, comprising a hydraulic power unit comprising a pump and valving for generation of pressured flow of a hydraulic fluid to drive the drive motor.

8. The system of claim 6, comprising a hydraulic power unit comprising a hydraulic accumulator and valving, the accumulator storing pressurized hydraulic fluid to drive the drive motor.

9. The system of claim 6, wherein the spool assembly is independently rotatable.

10. A multi-conductor hydraulic control hose reel system for well control, comprising:

a plurality of spool assemblies each having a core and first and second spaced lateral discs forming a storage space for simultaneous storage of multiple parallel hydraulic control hoses wound onto the core, the core having a central drive plate, one of the lateral discs having an access panel creating an inner umbilical space, the core having an entry aperture in communication with the umbilical space for passage of terminal umbilical ends of the control hoses into the umbilical space, a hydraulic drive motor mechanically coupled to the drive plate to drive the spool assembly in rotation, and a support structure holding the spool assembly and the drive motor, wherein the terminal umbilical ends comprise lengths of the hoses that are wound and stored in the umbilical space, and the access panel is movable to permit extraction of the terminal umbilical ends of the hoses from the umbilical space; and wherein when the multiple parallel control hoses are wound onto the core and prior to coupling of the terminal umbilical ends to other equipment, the terminal umbilical ends rotate with spool assembly;

wherein the spool assemblies are mounted generally parallel to one another on a support base; and a hydraulic power unit mounted on the support base and configured to selectively drive the hydraulic drive motor of each spool assembly to spool in the control hoses.

11. The system of claim 10, wherein the hydraulic power unit comprises a pump and valving for generation of pressured flow of a hydraulic fluid to drive the drive motors.

12. The system of claim 10, wherein the hydraulic power unit comprises a hydraulic accumulator and valving, the accumulator storing pressurized hydraulic fluid to drive the drive motors.

13. The system of claim 10, wherein each of the spool assemblies is independently rotatable.

14. A multi-conductor reel system comprising:

a spool assembly having a core and first and second spaced lateral discs forming a storage space for simultaneous storage of multiple parallel conductors wound onto the core, the first lateral disc having a central drive plate, the second lateral disc having central access panel creating an umbilical space, the core having an entry aperture in communication with the umbilical space for passage of terminal umbilical ends of the conductors into the umbilical space;

a drive motor mechanically coupled to the drive plate to drive the spool assembly in rotation;

a support structure holding the spool assembly and the drive motor; and wherein the access panel is movable for access to the terminal umbilical ends of the conductors; and wherein when the multiple parallel conductors are wound onto the core and prior to coupling of the terminal umbilical ends to other equipment, the terminal umbilical ends rotate with spool assembly.

15. The system of claim 14, comprising a locking structure to selectively prevent rotation of the spool assembly.

16. The system of claim 15, wherein the locking structure comprises a latch manually engaged with the spool assembly.

17. The system of claim 14, wherein the terminal umbilical ends comprise lengths of the conductors that are wound and stored in the umbilical space, and the access panel is movable to permit extraction of the terminal umbilical ends of the conductors from the umbilical space.

18. The system of claim 14, wherein the terminal umbilical ends of the conductors are terminated in the access panel via threaded or pluggable connectors.

19. The system of claim 14, comprising a drive system that provides power to drive the motor.

20. The system of claim 19, wherein the drive system comprises a hydraulic power unit.

* * * * *